United States Patent [19]

Schaffer et al.

[11] 4,326,814

[45] Apr. 27, 1982

[54] DOCUMENT PRINTING DEVICE HAVING A PLATEN WITH CHARACTER SEGMENTS THEREON

[75] Inventors: Robert R. Schaffer, Endwell; Dean W. Skinner, Binghamton, both of N.Y.

[73] Assignee: International Business Machines Corporation, Armonk, N.Y.

[21] Appl. No.: 131,573

[22] Filed: Mar. 19, 1980

[51] Int. Cl.[3] ..... B41J 3/06

[52] U.S. Cl. ..... 400/125.1; 101/93.04

[58] Field of Search ..... 101/93.04; 400/125, 400/125.1

[56] References Cited

U.S. PATENT DOCUMENTS

| | | | |
|---|---|---|---|
| 3,209,681 | 10/1965 | Sanborn | 400/125.1 X |
| 3,367,469 | 2/1968 | Fathauer | 101/93.04 X |
| 4,082,035 | 4/1978 | Englund | 101/93.04 |
| 4,084,503 | 4/1978 | Pylant et al. | 101/93.04 X |
| 4,092,921 | 6/1978 | McInnis et al. | 101/93.04 X |

FOREIGN PATENT DOCUMENTS

| | | | |
|---|---|---|---|
| 537343 | 6/1941 | United Kingdom | 400/125 |

*Primary Examiner*—Clifford D. Crowder
*Attorney, Agent, or Firm*—Saul A. Seinberg

[57] ABSTRACT

A printing device having a document feed path defined therein and a platen fixedly mounted adjacent the feed path, the platen having a plurality of character segments formed thereon. A plurality of impact members, there being at least one thereof for each character segment, are also positioned adjacent the document feed path and positioned thereat so that one of said impact members will strike one of the character segments. A spool-to-spool ribbon drive is adapted to position a print ribbon between the platen and the document in the feed path therefor and causes printing of each character segment where it is struck by an impact member. A document feed assembly is provided for moving each document along the feed path. Also provided is a control assembly operatively coupled between the document feed assembly and the impact members for selectively operating individual ones of the impact members in timed relationship to the motion of a document along the feed path to effect printing of selectable combinations of the character segments on the document.

8 Claims, 7 Drawing Figures

DOCUMENT PRINTING DEVICE HAVING A PLATEN WITH CHARACTER SEGMENTS THEREON

BACKGROUND OF THE INVENTION

1. Field of the Invention

This invention is related to printing apparatus and, more particularly, to a printing device which employs a fixedly mounted, segmented character platen to print symbols on unit documents.

2. Description of the Prior Art

It is known in the prior art that unit documents, checks or tickets, for example, could be printed in various devices with symbols such as numeric or alphabetic characters. Printing mechanisms in such devices were generally located at a print station to which the document was fed. Most frequently, such devices utilized a plurality of movable type wheels, belts or bars which carried engraved characters or symbols thereon. It was, therefore, necessary in such devices to coordinate and compensate for the moving print mechanism and the moving document. Slowing down or stopping the document limited the thruput of the devices, while speeding up the print mechanism relative to document velocity caused timing as well as wear, tension and/or smear problems.

OBJECTS AND SUMMARY OF THE INVENTION

Accordingly, it is a principal object of the present invention to provide unit document printing apparatus having relatively high thruput and relatively low maintenance costs.

It is another primary object of the subject invention to provide unit document printing apparatus which utilizes a fixedly mounted, low cost platen having character segments thereon.

It is a further object of the present invention to provide unit document printing apparatus having significantly reduced timing requirements.

The foregoing and other objects of the present invention are accomplished by providing printing apparatus having a document feed path defined therein and a platen fixedly mounted adjacent the feed path, the platen having a plurality of character segments formed thereon. Also provided is a plurality of impact members, there being at least one impact member for each of the character segments, mounted adjacent the document feed path and positioned thereat so that each of said impact members will strike, upon actuation, its corresponding character segment. Means for feeding documents into and through the printing apparatus along the document feed path are also provided. In addition, control means are furnished for selectively causing operation of individual ones of the impact members in timed relationship to the motion of a document along the feed path to thereby cause printing of selectable combinations of the character segments using a spool-to-spool driven ribbon placed between the document and the platen.

DESCRIPTION OF THE PREFERRED EMBODIMENT

Figure 1:
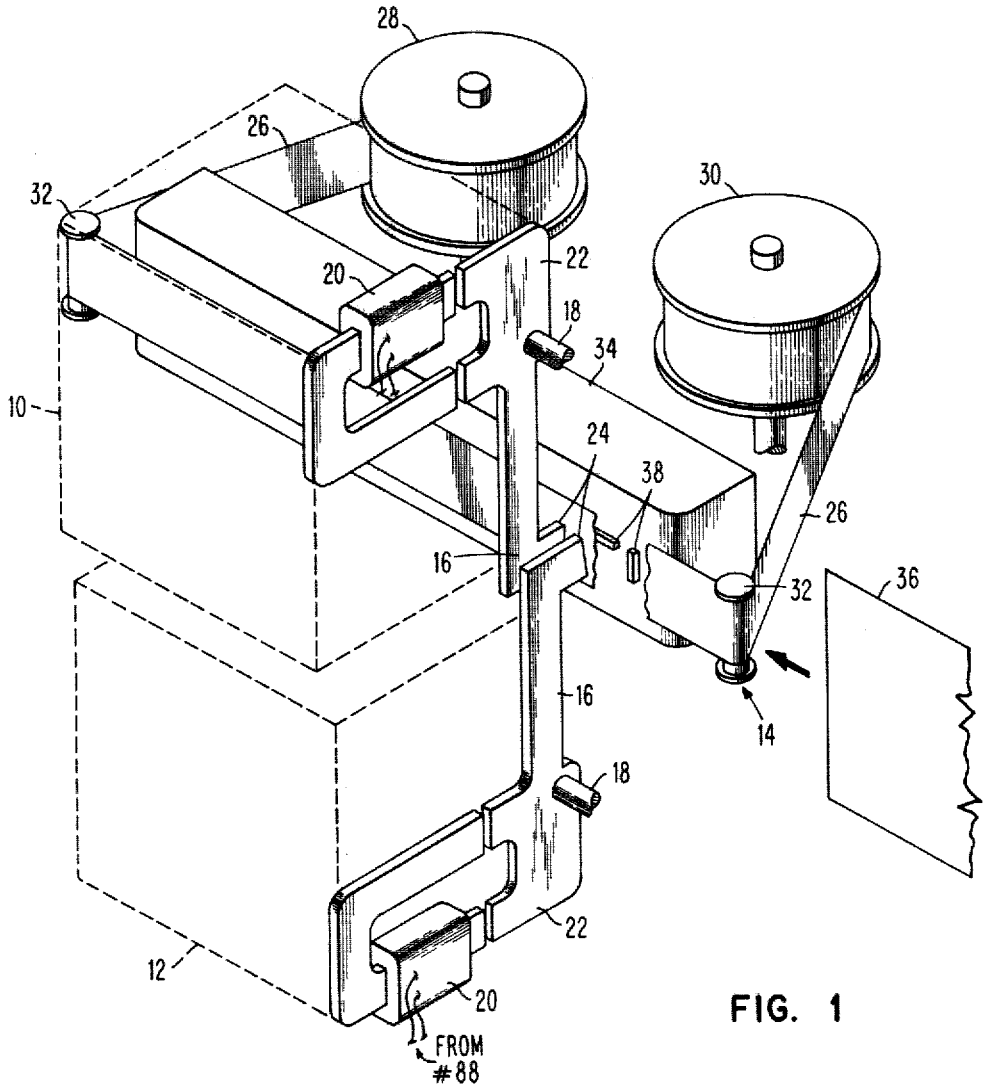
FIG. 1 is a partial isometric view of a printing mechanism implemented in accordance with the present invention.

Referring now to the drawings wherein like reference numerals have been used in the several views to identify like elements, FIG. 1 illustrates a printing mechanism implemented in accordance with the present invention. As shown, an upper hammer bank 10 and a lower hammer bank 12 are mounted adjacent a document feed path 14. The hammer banks 10 and 12 each include twenty-two hammers 16 on 0.20 inch centers. The hammer banks 10 and 12 are mounted so that their individual hammers 16 are interleaved on 0.10 inch centers. Each individual hammer 16 is pivotably mounted on a shaft 18 which extends across the width of each of the upper and lower hammer banks 10 and 12. When energized, the electromagnets 20 associated with each individual hammer 16 attract the base 22 thereof, pivoting the attracted hammer 16 towards the document path 14 about the pivot shaft 18. This action will cause the hammer face 24 to strike the document 36 and thereby cause document printing as will be more fully explained hereinafter.

The upper and lower hammer banks 10 and 12 are identical, low-cost units manufactured in accordance with the teachings of U.S. Pat. No. 3,747,521 issued to Hamilton et al and commonly assigned. The particular details of operation and construction of the hammer banks can be obtained by consulting this patent. To the extent necessary, this patent is incorporated herein by reference.

The print ribbon 26 is driven adjacent the document feed path 14 between a take-up spool 28 and a supply spool 30. The ribbon 26 is positionally stabilized in the document feed path 14 by being partially wrapped about two idler rollers 32.

Also mounted, in a removable manner, adjacent the document feed path 14, is a segmented character platen 34. It should be noted that the platen 34 is fixedly mounted on the opposite side of the ribbon 26 adjacent the document feed path 14. In operation, a document 36 is fed between the print ribbon 26 and the intended impact point of the hammers 16. Printing is accomplished by independently firing predetermined hammers 16 to cause their associated faces 24 to strike the document 36, ribbon 26, and a particular character segment 38.

Figure 2:
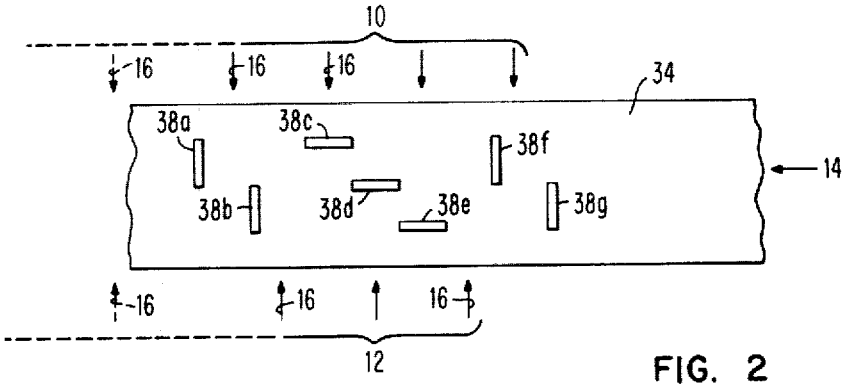
FIG. 2 is a top view of the segmented character platen used in the printing mechanism of FIG. 1.
Figure 3:
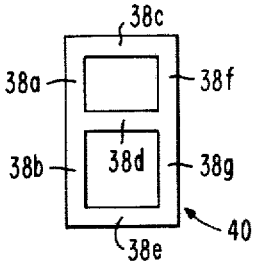
FIG. 3 illustrates a seven segement character matrix.

The segmented character platen 34 is shown in further detail in FIG. 2. The character segments 38 are formed in the platen by conventional methods such as, for example, molding or subtractive processes. For the single character position depicted in FIG. 2, seven character segments **38*a* to 38*g* are utilized to print a character. The matrix 40 therefor is shown in FIG. 3. Printing a "3" would require the use of segments 38*c* to 38*g*** while printing an "8" would require the use of all the character segments. Each character position on the platen 34 includes the seven matrix character segments and seven hammers, four from one of the hammer banks and three from the other, associated therewith. In the preferred embodiment, it is desired to print a six digit field on the document which would require forty-two hammers. Any extra hammers can be used, if desired, to print a special mark such as, for example, a period or dollar sign.

It is contemplated that the platen 34 will be made of a relatively inexpensive meterial in or on which the segmented characters can be readily and economically formed. It would then be simple and economical to replace platen 34 when it wears out rather than a more complex and costly part. Furthermore, if appropriate, the platen 34 can be changed to provide different sized characters or fonts. It should also be noted that the character segments can be formed on the hammer faces 24, if desired, but that could increase the maintenance costs.

Figure 4:
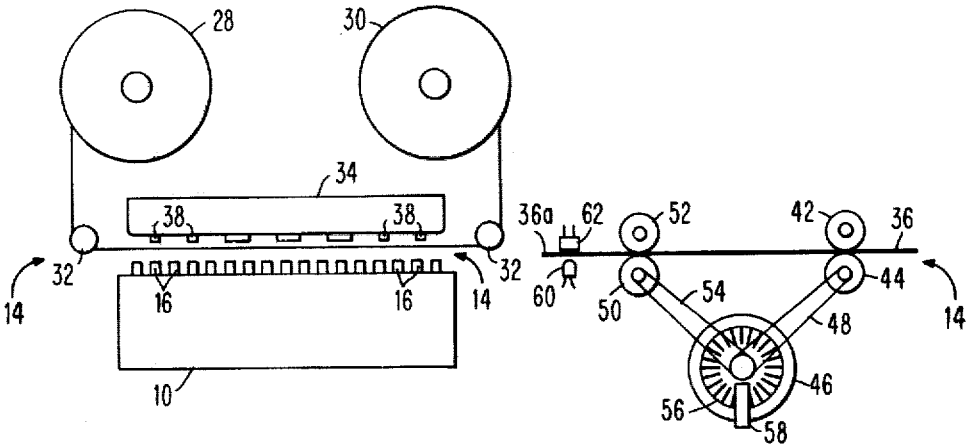
FIG. 4 schematically depicts the document drive means and motion sensing of a document being forwarded to the printing mechanism shown in FIG. 1.

FIG. 4 schematically illustrates the drive means for forwarding a document 36 to be printed and means for sensing the speed and location thereof relative to a fixed point. When the document 36 is inserted into the printing apparatus, as implemented in accordance with the present invention, its leading edge 36*a* is pinched between and driven by an idler roll 42 and drive roll 44. The drive roll 44 receives its power from drive motor 46 via belt 48. Similarly, the drive motor 46 also rotates drive roll 50 via belt 54. The idler roll 52 is also driven as a result of drive roll 50 rotation.

A timing disk 56 having a series of equally spaced position indicia thereon is mounted on the drive motor 46. A position emitter 58 is located adjacent the timing disk 56 and adapted to emit a signal each time one of the position indicia passes it by. A light source 60 and sensor 62 are mounted further along the document feed path 14. When the leading edge 36*a* of the document reaches the light source 60, it breaks or interferes with the light beam causing the sensor 62 to emit a signal indicative of the passage of the leading edge of a document.

Figure 5:
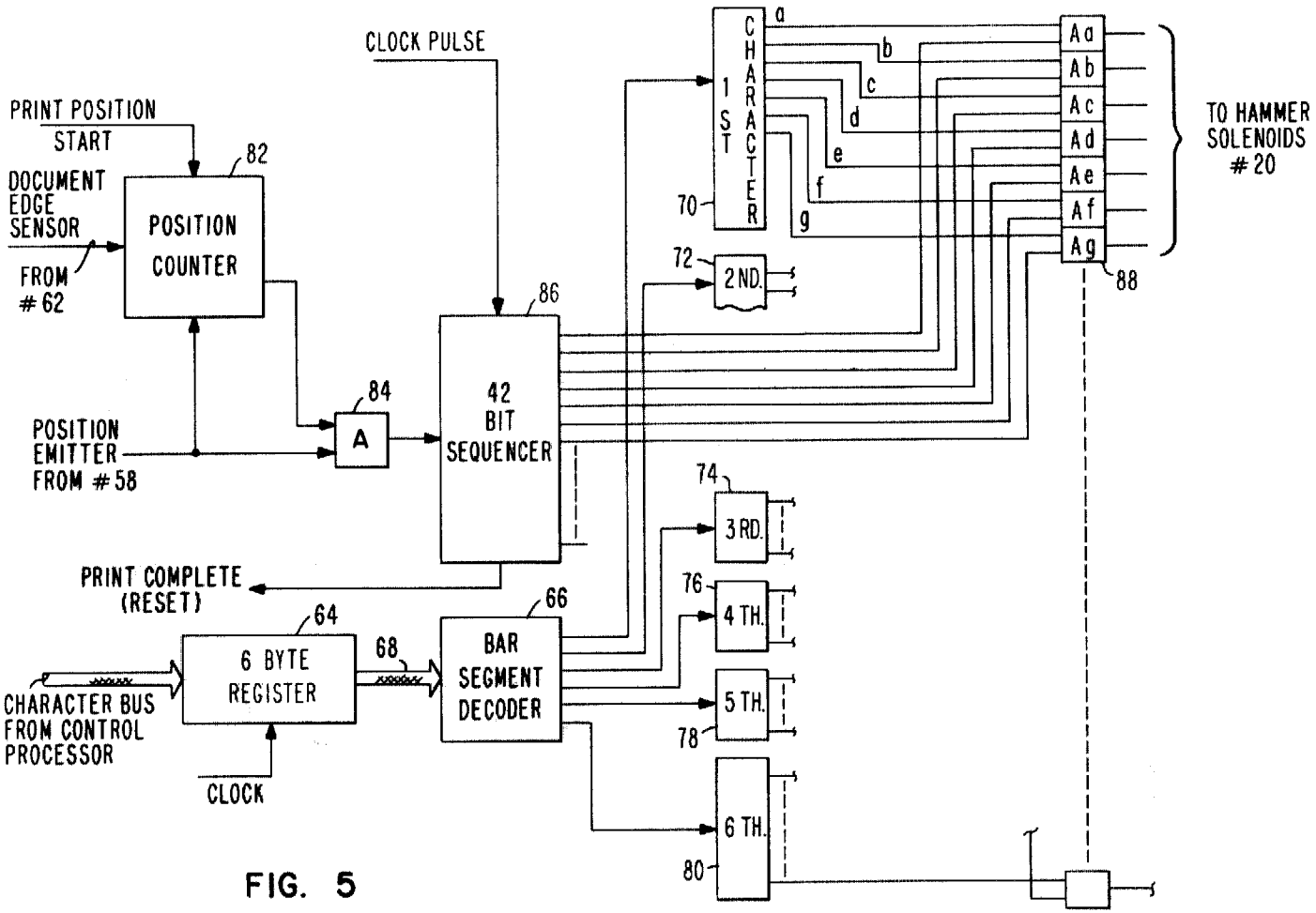
FIG. 5 is a schematic representation of the print control means employed to operate the printing mechanism of FIG. 1.

FIG. 5 illustrates in functional format, the basic elements involved in the control of the printing mechanism of the present invention. For purposes of this description, it is assumed that a six-character number is to be printed on the document. Thus, using a seven segment character matrix, forty-two hammers and control lines therefor would be needed.

Typically, a starting number to be printed is operator selected and printed on the first document with all subsequent numbers being automatically incremented. The starting number is inputted to a control processor (not shown) which loads the characters thereof via a character bus into a six byte register 64, one byte being reserved for each character. The contents of register 64 are then shifted, under clock control, to a bar segment decoder 66 via bus 68.

The decoded bar segments for the first character are then separately forwarded to and loaded in print register 70. In a similar manner, the decoded bar segment signals for the next five characters are forwarded to and loaded in print registers 72, 74, 76, 78 and 80, respectively. The control processor then loads a binary count into the position counter 82 which completes the control preparation for printing.

When the leading edge 36*a* of the document 36 is sensed, the resulting signal from sensor 62 initiates a decremental countdown by the position counter 82. Thereafter, the countdown is continued by the position emitter 58 signal, at one count for each position emitter signal received. When the position counter 82 reaches zero, it generates a continuous pulse, until reset, which is ANDed in gate 84 with the position emitter output signal. When the output of gate 84 goes to a logical HI, the forty-two bit sequencer 86 is started.

Bit sequencer 86 has forty-two output lines which are set to a logical HI in order, from the first to the forty-second, under triggering action of the position emitter signal. Thus, the initial position emitter signal after position counter 82 has reached a zero count, energized the first output line of sequencer 86 with succeeding position emitter signals energizing succeeding output lines of the sequencer 86. A separately generated clock pulse is delivered to sequencer 86 to develop and control the width of the sequencer's output pulses. This pulse width control can be and is utilized to control the hammer current pulse.

The output lines of the sequencer 86 are ANDed with the character segment bits of the respective print registers. The first character printing is, for example, controlled by ANDing the seven output lines of the first character print register 70 with the first seven output lines of the sequencer 86 in logic gates 88*a* to 88*g*. In a similar manner, the output lines of each of the remaining print registers 72, 74, 76, 78 and 80 are ANDed with succeeding groups of seven of the output lines of sequencer 86. This yields appropriate hammer firing pulses for the matrix of each of the six characters in the number to be printed.

One example should suffice to explain the control arrangement for printing of a character. Let it be assumed that the character "3" is to be the first character printed on the document 36. As will be recalled, printing a "3" requires that the character segments 38*c* to 38*g* of platen 34 be struck by their corresponding hammers 16. Since the character segments 38*a* and 38*b* will not be required, the output lines 70*a* and 70*b* of the print register 70 will be kept at a logical LO which, in turn, keeps AND gates 88*a* and 88*b* disabled. The remaining AND gates 88*c* to 88*g* are toggled by the sequencer 86 output lines as they are set to a logical HI. When the last character segment is printed, this fact is made logically known by the sequencer setting the PRINT COMPLETE or reset line to a logical HI when its last or forty-second output line goes HI. The reset signal is then used to reset the position counter 82 and clear all registers which prepares the control means of FIG. 5 to print the next document.

Figure 6A:
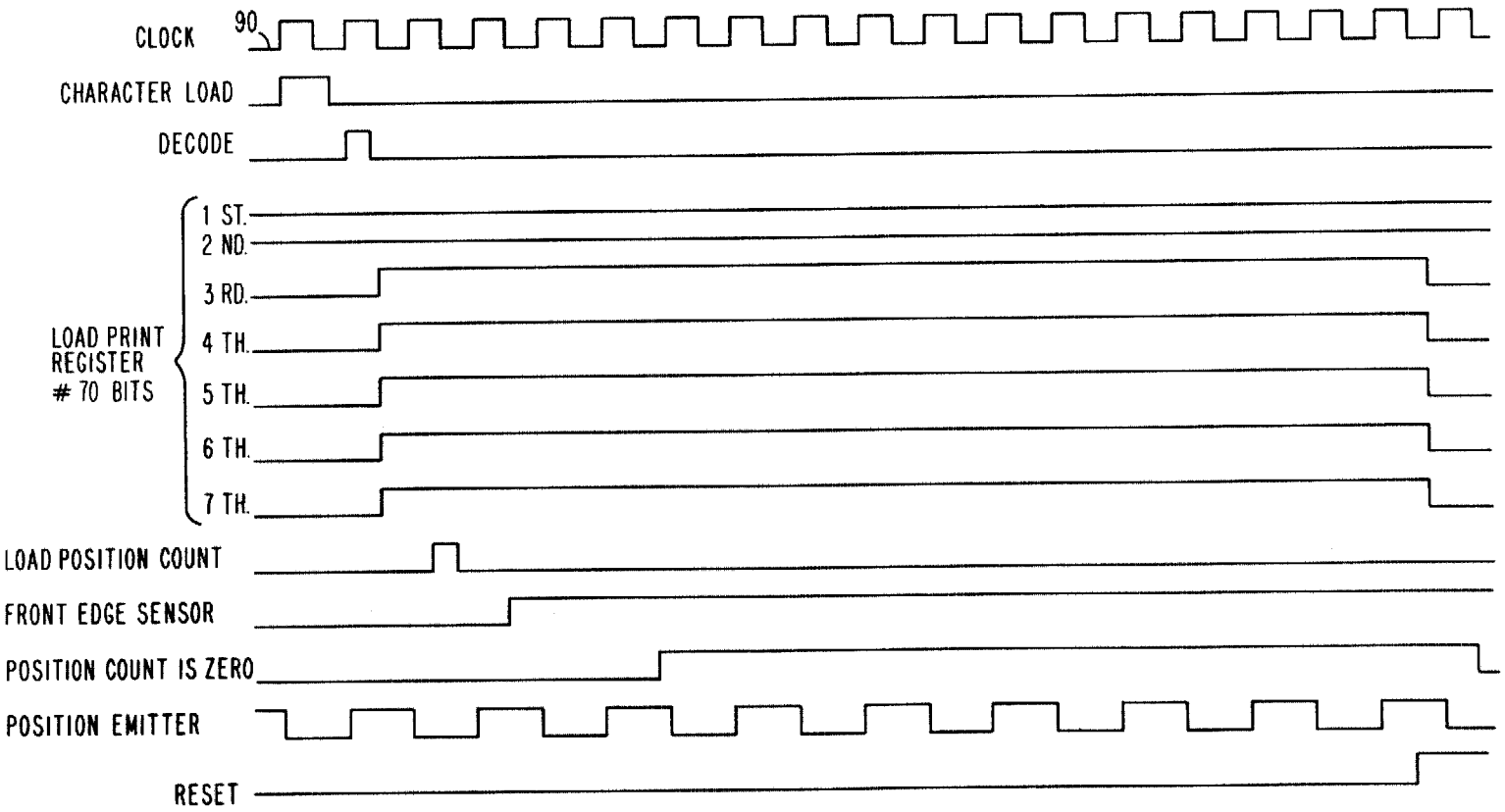
FIGS. 6A and 6B are timing diagrams which depict the time-based relationship of the signals developed by the various sensors and elements respectively of FIGS. 4 and 5.
Figure 6B:
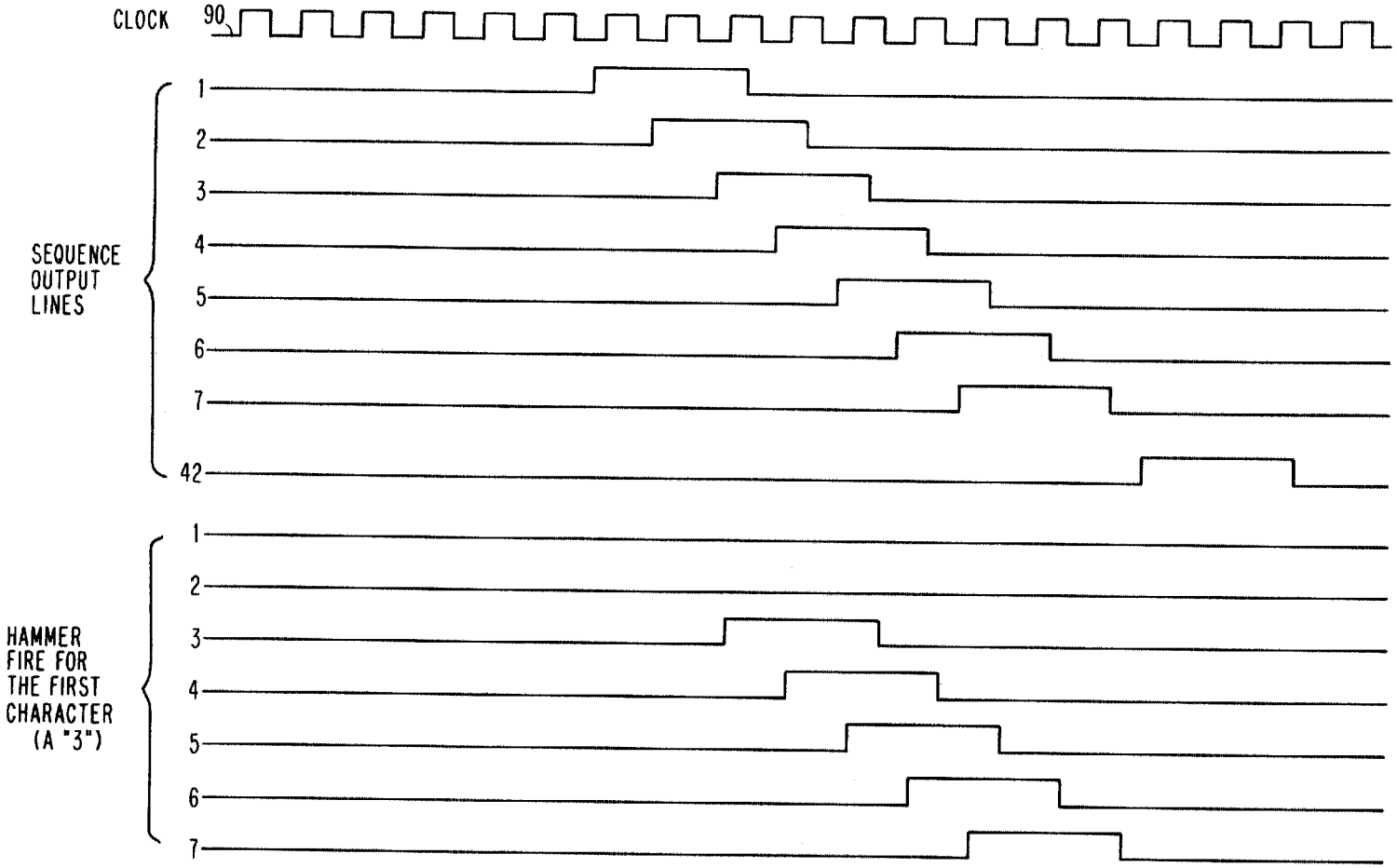

A timing diagram of the various signals and device output states for printing the character "3" is illustrated in FIGS. 6A and 6B. An identical clock pulse signal 90 is shown at the top portion of each and serves as a frame of reference for following the control aspects of the printing operation.

While the present invention has been described in the context of a preferred embodiment thereof, it will be readily apparent to those skilled in the art, that modifications and variations can be made therein without departing from the spirit and scope of the present invention. Accordingly, it is not intended that the present invention be limited to the specifics of the foregoing description of the preferred embodiment, but rather as being limited only by the scope of the invention as defined in the claims appended hereto.

We claim:

1. Apparatus for printing on a document, said apparatus comprising:

(a) a document feed path defined in and through said apparatus, (b) a platen, non-movably and fixedly mounted in said apparatus adjacent said document feed path, said platen having a plurality of character segments formed thereon;

(c) a plurality of movable impact members, there being at least one impact member associated with each of said character segments, said impact members being movably mounted adjacent said document feed path proximate to said platen and positioned there so that said impact members when moved will strike its associated character segment;

(d) document feeding means for feeding a document along said document feed path; and (e) control means for selectively moving predetermined combinations of said impact members in timed relationship to the motion of a document along said document feed path to cause said moved impact members to strike their associated character segments.

2. The apparatus according to claim 1 wherein said platen's plurality of character segments are grouped thereon to form one character matrix for each character to be printed on the document.

3. The apparatus according to claim 2 wherein said platen is removably mounted therein.

4. The apparatus according to claim 1 wherein said platen is removably mounted therein.

5. The apparatus according to claim 1 which additionally comprises inking means disposed near said platen in the path of said impact members.

6. The apparatus according to claim 5 wherein said platen's plurality of character segments are grouped thereon to form one character matrix for each character to be printed on the document.

7. The apparatus according to claim 6 wherein said platen is removably mounted therein.

8. The apparatus according to claim 5 wherein said platen is removably mounted therein.

* * * * *